US007182243B2

(12) United States Patent
Plappert

(10) Patent No.: US 7,182,243 B2
(45) Date of Patent: Feb. 27, 2007

(54) MAIL SLOT ASSEMBLY

(76) Inventor: Thomas W. Plappert, 303 Maize Dr., Pleasant Hills, PA (US) 15236

( * ) Notice: Subject to any disclaimer, the term of this patent is extended or adjusted under 35 U.S.C. 154(b) by 316 days.

(21) Appl. No.: 10/955,124

(22) Filed: Sep. 30, 2004

(65) Prior Publication Data

US 2006/0065705 A1 Mar. 30, 2006

(51) Int. Cl.
*A47G 29/12* (2006.01)

(52) U.S. Cl. ..... 232/19

(58) Field of Classification Search ..... 232/19, 232/17, 28, 29, 30; 220/478
See application file for complete search history.

(56) References Cited

U.S. PATENT DOCUMENTS

| | | | | |
|---|---|---|---|---|
| 166,800 | A | 8/1875 | Newcomer | |
| 358,458 | A | 3/1887 | Moore | |
| 449,593 | A * | 3/1891 | Scott | 232/19 |
| 782,229 | A | 2/1905 | Field | |
| 1,797,961 | A | 3/1931 | McBride | |
| 2,829,820 | A * | 4/1958 | Evers | 232/19 |
| 3,802,620 | A * | 4/1974 | Ferrara | 232/19 |
| 4,069,965 | A | 1/1978 | Maddox, Jr. | |
| 4,776,512 | A | 10/1988 | Moore, Sr. et al. | |
| 5,316,060 | A | 5/1994 | Hodgdon et al. | |
| 5,368,226 | A | 11/1994 | Franceschino | |
| 5,492,272 | A | 2/1996 | Fewer | |
| 6,959,858 | B2 * | 11/2005 | Stagnaro | 232/19 |
| 2002/0070269 | A1 * | 6/2002 | Rosiello et al. | 232/19 |

* cited by examiner

*Primary Examiner*—William L. Miller
(74) *Attorney, Agent, or Firm*—The Webb Law Firm

(57) ABSTRACT

A mail slot receiver for use with a door having a mail slot therein comprising an outer frame member pivotably attached to an inner frame member and a receptacle attached to the inner frame member, whereby the inner frame member can pivotably rotate between a mail receiving position and a mail retrieving position.

19 Claims, 2 Drawing Sheets

MAIL SLOT ASSEMBLY

BACKGROUND OF THE INVENTION

1. Field of the Invention

The present invention relates to mail receptacles and, more particularly, to a mail slot assembly for receiving and retrieving mail through a mail slot of a door.

2. Description of the Prior Art

The use of mail receptacles are known in the art. Typically, these mail receptacles are attached to a door having a mail slot therein, wherein mail passes through the mail slot and is received into the receptacle. The mail receptacle, such as a bag, can either surround the mail slot or be positioned underneath the mail slot of a door in order to receive mail passing through the mail slot. Such prior art mail receptacles are disclosed in U.S. Pat. Nos. 782,229; 1,797,961; 4,069,965; 4,776,512; 5,368,226 and 5,492,272.

In prior art mail receptacles, the retrieving of the mail from mail receptacles that surround the mail slot typically requires that the open end of the mail receptacle be removed from the surface of the door surrounding the mail slot in order to retrieve the mail. Also, retrieving of the mail can occur by unzipping or untying the receptacle from either the bottom or side in order to retrieve mail from the receptacle. In either of these cases, mail retrieval requires the additional time to either replace the open end of the receptacle over the mail slot or retie or zip up the mail receptacle after the mail is retrieved.

In prior art mail receptacles, wherein the receptacle, is positioned underneath the mail slot, retrieval of the mail is easier than in mail receptacles that surround the mail slot. However, these mail receptacles generally include a frame at the open end of the receptacle that extends axially away from the surface surrounding the mail slot. These types of mail receptacles typically extend approximately 6 to 12 inches away from the door. Although the retrieval of the mail is easier in this case, this extension takes up additional space and can sometimes be a safety hazard, especially when the frame surrounding the opening of the receptacle is made of a rigid material.

It is desirable to have a mail slot receptacle that surrounds the mail slot of a door, and provides for easy retrieval of the mail from the open end of the receptacle without the complete removal of the receptacle from the surface of the door surrounding the mail slot. Therefore, it is an object of the present invention to overcome the above-mentioned deficiencies by providing a mail slot assembly that takes up less space and provides for easy retrieval of the mail from the mail receptacle.

SUMMARY OF THE INVENTION

The present invention provides for a mail slot receiver for use with a door having a mail slot therein. The mail slot receiver comprises an outer frame member having an upper end and a lower end and defining a central opening, and an inner frame member having a first end and a second end and defining a central passageway, wherein the first end of the inner frame member is pivotably attached to the lower end of the outer frame member. The mail slot receiver also comprises a receptacle having an open end attached to the inner frame member and a latch assembly defined on the upper end of the outer frame member and the second end of the inner frame member, wherein the latch assembly is adapted to secure the inner frame member to the outer frame member when the inner frame member is received within the outer frame member.

The present invention also provides for a mail slot assembly comprising a door having a surface and defining a mail slot therein, and a mail slot receiver as previously discussed, wherein the outer frame member of the mail slot receiver is attached to the surface of the door surrounding the mail slot.

The present invention provides for a method of retrieving mail from a mail slot. First, an outer frame member of a mail slot receiver, as previously discussed, is attached to a surface surrounding a mail slot in a door. Next, the inner frame member is pivotably rotated away from the outer frame member. Lastly, mail is retrieved from the receptacle, wherein the mail is received into the receptacle by passing through the mail slot, the central opening of the outer frame member and the central passageway of the inner frame member of the mail slot receiver.

DETAILED DESCRIPTION OF THE INVENTION

Figure 1:
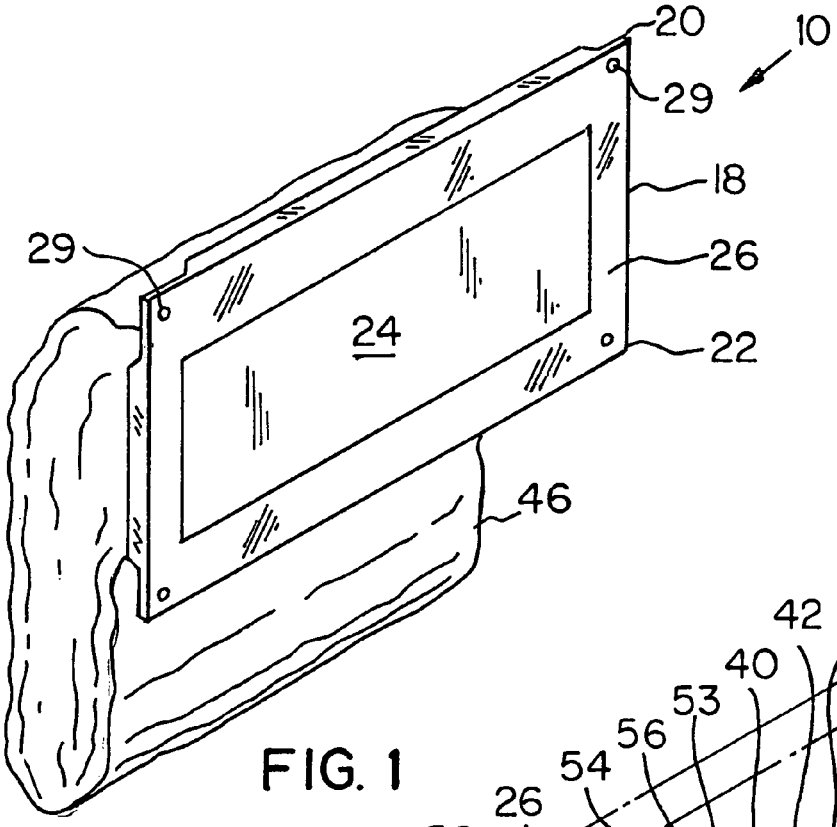
FIG. 1 is a perspective view of a mail slot receiver made in accordance with the present invention.
Figure 2:
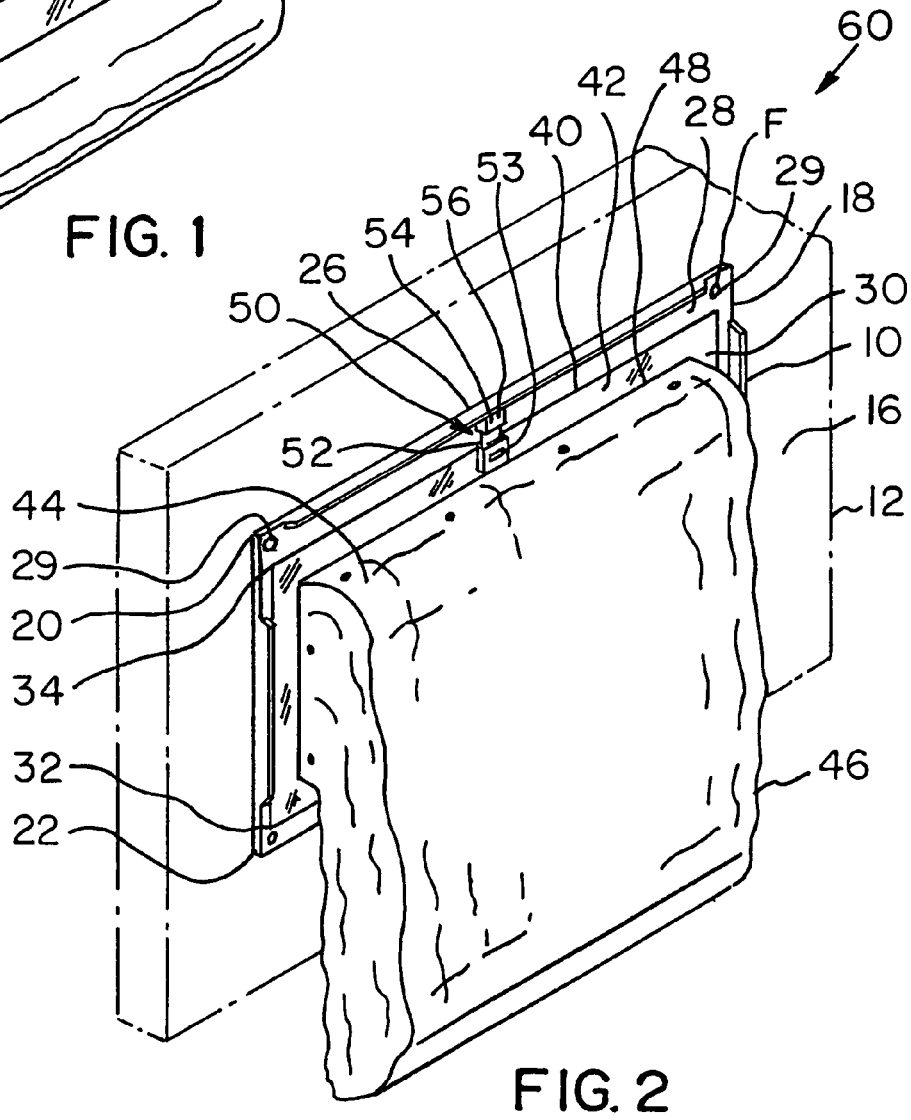
FIG. 2 is a perspective view of the mail slot receiver shown in FIG. 1 mounted on a door surrounding a mail slot.
Figure 3:
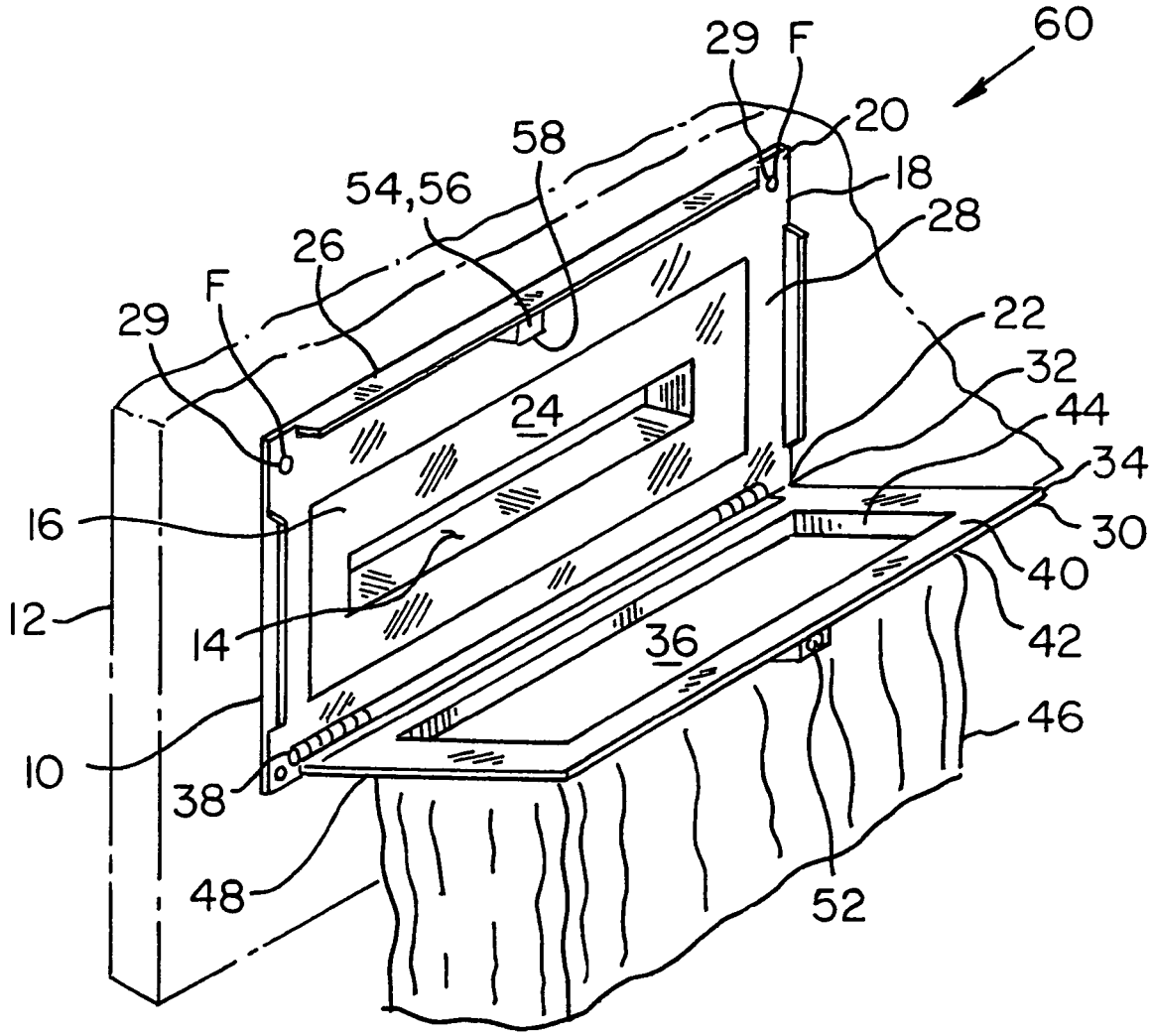
FIG. 3 is a perspective view of the mail slot receiver shown in FIG. 2 in a mail retrieving second position.

Referring to FIGS. 1–3, the present invention provides for a mail slot receiver 10 that is adapted to be mounted to a door 12 having a mail slot 14 therein (shown in FIG. 3). The mail slot receiver 10 comprises an outer frame member 18, an inner frame member 30 pivotably attached to the outer frame member 18, and a receptacle 46 attached to the inner frame member 30 for receiving mail therein. The outer frame member 18 having an upper end 20 and a lower end 22 and defining a central opening 24 comprises a first surface 26 (shown in FIG. 1) and a second surface 28, wherein the first surface 26 is adapted to abut against a surface 16 of a door 12 surrounding the mail slot 14 (shown in FIG. 2). A plurality of slots 29 can be defined in the outer frame member 18, wherein the first surface 26 is adapted to attach to the surface 16 of the door 12 via a fastener F passing through the slot 29 of the outer frame member 18 and the surface 16 of the door 12 (shown in FIGS. 2 and 3).

Referring to FIGS. 2 and 3, the inner frame member 30 having a first end 32 and a second end 34 and defining a central passageway 36 is pivotably attached at the first end 32 of the inner frame member 30 to the lower end 22 of the outer frame member 18 via a hinge 38 (shown in FIG. 3). The inner frame member 30 further comprises a front surface 40 and a rear surface 42, wherein the hinge 38 is attached to the front surface 40 of the inner frame member 30 and the second surface 28 of the outer frame member 18. The hinge 38 can be a single hinge that extends the entire length of the frame members 18 and 30 or a plurality of spaced apart hinges (not shown). A lip 44 positioned adjacent the central passageway 36 extends away from the rear surface 42 of the inner frame member 30, wherein the receptacle 46 can be attached to the lip 44 of the inner frame member 30 (shown in FIG. 2). The frame members 18, 30 can be rectangular shaped and can vary in size depending on the size of the mail slot 14 in the door 12. The frame members 18, 30 can be made of a rigid material such as metal or plastic.

Referring to FIGS. 2 and 3, the receptacle 46 having an open end 48, such as a bag, can be attached to the lip 44 of the inner frame member 30 via mechanical fasteners such as rivets. The receptacle 46 can be made of a transparent material such that a person can see the mail inside the receptacle 46. The receptacle 46 can also be made out of a flexible material such as fabric.

With continued reference to FIGS. 2 and 3, a latch assembly 50 is defined on the upper end 20 of the outer frame member 18 and the second end 34 of the inner frame member 30, wherein the latch assembly 50 is adapted to secure the inner frame 30 to the outer frame member 18 when the inner frame member 30 is received within the outer frame member 18. The latch assembly 50 comprises a latch member 52 defined on the second end 34 of the rear surface 42 of the inner frame member 30, a handle 53 attached to the latch member 52 and a latch receiving portion 54 defined on the upper end 20 of the second surface 28 of the outer frame member 18. The latch receiving portion 54 comprises a housing 56 defining a cavity 58, wherein the latch member 52 is adapted to be received within the cavity 58 of the housing 56 of the latch receiving portion 54 when the front surface 40 of the inner frame member 30 abuts against the second surface 28 of the outer frame member 18. The handle 53 coacts with the latch member 52, wherein the latch member 52 is adapted to disengage the latch receiving portion 54 when the handle 53 is activated, thereby allowing the inner frame member 30 to pivotably rotate such that the inner frame member 30 extends away from the outer frame member 18 (shown in FIG. 3). Any other type of mechanism can be used to prevent the inner frame member 30 from pivotably rotating away from the outer frame member 18. Non-limiting examples of such mechanism can include a magnetic latch, a hook and loop fastener, and a nut and bolt assembly.

With continued reference to FIGS. 2 and 3, the present invention also provides for a mail slot assembly 60 that includes a mail slot receiver 10 as previously discussed attached to a surface 16 of a door 12 surrounding a mail slot 14. The first surface 26 of the outer frame member 18 can be attached to the surface 16 of the door 12 via a fastener F passing through the slot 29 in the outer frame member 18 and the surface 16 of a door 12. Alternatively, the outer frame member 18 can be attached to the surface 16 of the door 12 via an adhesive.

FIG. 2 shows the mail slot assembly 60 in a first position wherein the front surface 40 of the inner frame member 30 abuts against the second surface 28 of the outer frame member 18. FIG. 3 shows the mail slot assembly 60 in a second position, wherein the inner frame member 30 extends away from the outer frame member 18. The inner frame member 30 can pivotably rotate between the first position and the second position, wherein the latch member 52 engages the latch receiving portion 54 when said inner frame member 30 is in the first position (shown in FIG. 2). When the handle 53 is activated, the latch member 52 disengages the latch receiving portion 54, thereby allowing the inner frame member 30 to pivot into the second position (shown in FIG. 3).

The present invention also provides for a method for retrieving mail passing through a mail slot 14 in a door 12 utilizing the mail slot receiver 10 as previously discussed. First, the outer frame member 18 of the mail slot receiver 10 is attached to a surface 16 surrounding a mail slot 14 in a door 12. Mail is received into the receptacle 46 by passing through the mail slot 14 of the door 12, the central opening 24 of the outer frame member 18 and the central passageway 36 of the inner frame member 30 of the mail slot receiver 10. Next, the latch member 52 of the latch assembly 50 disengages the latch receiving portion 54 and the inner frame member 30 is pivotably rotated away from the outer frame member 18. Lastly, mail is retrieved from the open end 48 of the receptacle 46. After the mail is retrieved, the inner frame member 30 can then be pivotably rotated toward the outer frame member 18, wherein the latch member 52 engages the latch receiving portion 54, thereby securing the inner frame member 32 to the outer frame member 18.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A mail slot receiver for use with a door having a mail slot therein, said mail slot receiver comprising:

an outer frame member having an upper end and a lower end and defining a central opening;

an inner frame member having a first end and a second end and defining a central passageway, said first end of said inner frame member pivotably attached to said lower end of said outer frame member;

a receptacle having an open end attached to said inner frame member and a latch assembly defined on said upper end of said outer frame member and said second end of said inner frame member, wherein said latch assembly is adapted to secure said inner frame member to said outer frame member when said inner frame member is received within said outer frame member.

2. The mail slot receiver as claimed in claim 1, wherein said inner frame member comprises a front surface and a rear surface and said outer frame member comprises a first surface and a second surface, said inner frame member adapted to pivotably rotate between a first position and a second position, wherein said front surface of said inner frame member abuts against said second surface of said outer frame member when in the first position, and wherein said inner frame member extends away from said outer frame member when in the second position.

3. The mail slot receiver as claimed in claim 2, wherein said inner frame member is pivotably attached to said outer frame member via at least one hinge attached to said front surface of said inner frame member and said second surface of said outer frame member.

4. The mail slot receiver as claimed in claim 2, wherein said rear surface of said inner frame member comprises a lip adjacent the central passageway and extending away from the rear surface of said inner frame member, wherein said open end of said receptacle attaches to said lip.

5. The mail slot receiver as claimed in claim 2, wherein said first surface of said outer frame member is adapted to attach to a surface of said door surrounding said mail slot.

6. The mail slot receiver as claimed in claim 2, wherein said latch assembly comprises a latch member and a latch receiving portion, said latch member defined on said second end of said rear surface of said inner frame member and said latch receiving portion defined on said upper end of said second surface of said outer frame member, wherein said latch member is adapted to engage said latch receiving portion when said inner frame member is in said first position.

7. The mail slot receiver as claimed in claim 6, wherein said latch receiving portion comprises a housing defining a cavity, wherein said latch member is adapted to be received within the cavity of said housing when said inner frame member is in said first position.

8. The mail slot receiver as claimed in claim 6, wherein said latch assembly further comprises a handle attached to said latch member, wherein said latch member is adapted to disengage said latch receiving portion when said handle is activated.

9. The mail slot receiver as claimed in claim 1, wherein at least one slot is defined on said outer frame member, said outer frame member adapted to attach to a surface of said door surrounding said mail slot via a fastener passing through the slot in the outer frame member and said surface surrounding said mail slot.

10. The mail slot receiver as claimed in claim 1, wherein said outer frame member is adapted to attach to a surface of said door surrounding said mail slot via an adhesive.

11. The mail slot receiver as claimed in claim 1, wherein said inner frame member is pivotably attached to said outer frame member via at least one hinge.

12. The mail slot receiver as claimed in claim 1, wherein said outer frame member and said inner frame member are rectangular shaped.

13. The mail slot receiver as claimed in claim 1, wherein said outer frame member and said inner frame member are made of a rigid material.

14. The mail slot receiver as claimed in claim 1, wherein said receptacle is made of a transparent material.

15. The mail slot receiver as claimed in claim 1, wherein said receptacle is made of fabric.

16. A mail slot assembly comprising:

a door having a surface and defining a mail slot therein; and a mail slot receiver comprising an outer frame member having an upper end and a lower end and defining a central opening, an inner frame member having a first end and a second end and defining a central passageway, said first end of said inner frame member pivotably attached to said lower end of said outer frame member, a receptacle having an open end attached to said inner frame member, and a latch assembly defined on said upper end of said outer frame member and said second end of said inner frame member, wherein said latch assembly is adapted to secure said inner frame member to said outer frame member when said inner frame member is received within said outer frame member, wherein said outer frame member of said mail slot receiver is attached to said surface of said door surrounding said mail slot.

17. The mail slot assembly as claimed in claim 16, wherein at least one slot is defined in said outer frame member of said mail slot receiver, said outer frame member attached to said surface of said door via a fastener passing through the slot in said outer frame member and said surface of said door.

18. A method of retrieving mail passing through a mail slot, said method comprising the steps of:

a) providing a mail slot receiver comprising an outer frame member having an upper end and a lower end and defining a central opening, an inner frame member having a first end and a second end and defining a central passageway, said first end of said inner frame member pivotably attached to said lower end of said outer frame member, a receptacle having an open end attached to said inner frame member, and a latch assembly defined on said upper end of said outer frame member and said second end of said inner frame member, wherein said latch assembly is adapted to secure said inner frame member to said outer frame member when said inner frame member is received within said outer frame member;

b) attaching said outer frame member of said mail slot receiver to a surface surrounding a mail slot in said door;

c) pivotably rotating said inner frame member away from said outer frame member; and d) retrieving said mail from said receptacle, wherein said mail is received into said receptacle by passing through the mail slot, the central opening of said outer frame member and the central passageway of said inner frame member of said mail slot receiver.

19. The method as claimed in claim 18, further comprising the step of pivotably rotating said inner frame member toward said outer frame member, thereby securing said inner frame member to said outer frame member.

* * * * *